US010945513B2

(12) United States Patent
de Martino

(10) Patent No.: US 10,945,513 B2
(45) Date of Patent: Mar. 16, 2021

(54) COMPACT COSMETIC CASE

(71) Applicant: ESSENTIA BEAUTY S.r.l., Monza (IT)

(72) Inventor: Katia de Martino, Monza (IT)

(73) Assignee: ESSENTIA BEAUTY S.r.l., Monza (IT)

( * ) Notice: Subject to any disclaimer, the term of this patent is extended or adjusted under 35 U.S.C. 154(b) by 216 days.

(21) Appl. No.: 16/047,360

(22) Filed: Jul. 27, 2018

(65) Prior Publication Data

US 2020/0029675 A1 Jan. 30, 2020

(51) Int. Cl.

| | |
|---|---|
| ***A45D 40/24*** | (2006.01) |
| ***A45D 33/00*** | (2006.01) |
| ***A45D 34/06*** | (2006.01) |
| ***A45D 42/02*** | (2006.01) |
| ***A45D 33/28*** | (2006.01) |

(52) U.S. Cl.

CPC ..... *A45D 40/24* (2013.01); *A45D 33/008* (2013.01); *A45D 33/28* (2013.01); *A45D 34/06* (2013.01); *A45D 42/02* (2013.01); *A45D 2200/25* (2013.01)

(58) Field of Classification Search

CPC ..... A45D 40/24; A45D 40/02; A45D 33/008; A45D 34/06; A45D 2040/0018; A45D 42/02; A45D 33/28; A45D 2200/25

See application file for complete search history.

(56) References Cited

U.S. PATENT DOCUMENTS

| | | | | | |
|---|---|---|---|---|---|
| 2,375,027 | A | * | 5/1945 | Naidech | A45D 40/264 132/317 |
| 2,533,507 | A | * | 12/1950 | Risberg | A45D 33/28 132/315 |
| 2,650,597 | A | * | 9/1953 | Girard | A45D 40/18 132/316 |
| 3,132,653 | A | * | 5/1964 | Gazdik | A45D 40/24 206/15.2 |
| 3,397,707 | A | * | 8/1968 | Aversa | A45D 40/262 132/317 |
| 3,482,728 | A | * | 12/1969 | Flax | A45D 40/24 220/525 |

(Continued)

FOREIGN PATENT DOCUMENTS

EM 003241116-0001 7/2016

*Primary Examiner* — Rachel R Steitz
*Assistant Examiner* — Brianne E Kalach
(74) *Attorney, Agent, or Firm* — Maier & Maier, PLLC

(57) ABSTRACT

A cosmetic case including an inner body carrying on its outer surface a plurality of basin-shaped receptacles for housing a cosmetic product or a cosmetic article, and a number of cosmetic products and/or cosmetic articles each retained within a basin-shaped receptacle of the plurality of basin-shaped receptacles, where the inner body has an elongated shape developing along a main axis, the shape of the inner body being provided with a lateral surface developing around the main axis, and a first and a second end surface transversal to the main axis; where at least one basin-shaped receptacle of the plurality of basin-shaped receptacles is provided on the lateral surface of the inner body; and where at least one elongated receptacle is provided inside the inner body, extending parallel to the main axis and accessible through an aperture obtained on the first and/or second end surface of the inner body.

19 Claims, 9 Drawing Sheets

(56) References Cited

U.S. PATENT DOCUMENTS

| | | | | |
|---|---|---|---|---|
| 4,679,692 | A * | 7/1987 | Davey | A45D 40/00 132/286 |
| 4,777,969 | A * | 10/1988 | Holloway | A45D 33/006 132/293 |
| 5,135,112 | A * | 8/1992 | Kamen | A45D 33/006 132/294 |
| 5,715,848 | A * | 2/1998 | Conley, Jr. | A45C 11/008 132/297 |
| 6,073,634 | A * | 6/2000 | Gueret | A45D 40/22 132/218 |
| 7,047,983 | B2 * | 5/2006 | Manougian | A45D 33/006 132/294 |
| 7,165,558 | B2 * | 1/2007 | Byun | A45D 33/24 132/294 |
| 7,753,608 | B2 * | 7/2010 | Hsing | A45D 40/20 206/385 |
| 2005/0000850 | A1 * | 1/2005 | Young | A45D 40/24 206/581 |
| 2013/0058583 | A1 | 3/2013 | Gallagher et al. | |
| 2014/0093299 | A1 * | 4/2014 | Lambert | A45D 40/18 401/52 |
| 2015/0021347 | A1 * | 1/2015 | Yoshida | A45D 40/221 220/830 |

* cited by examiner

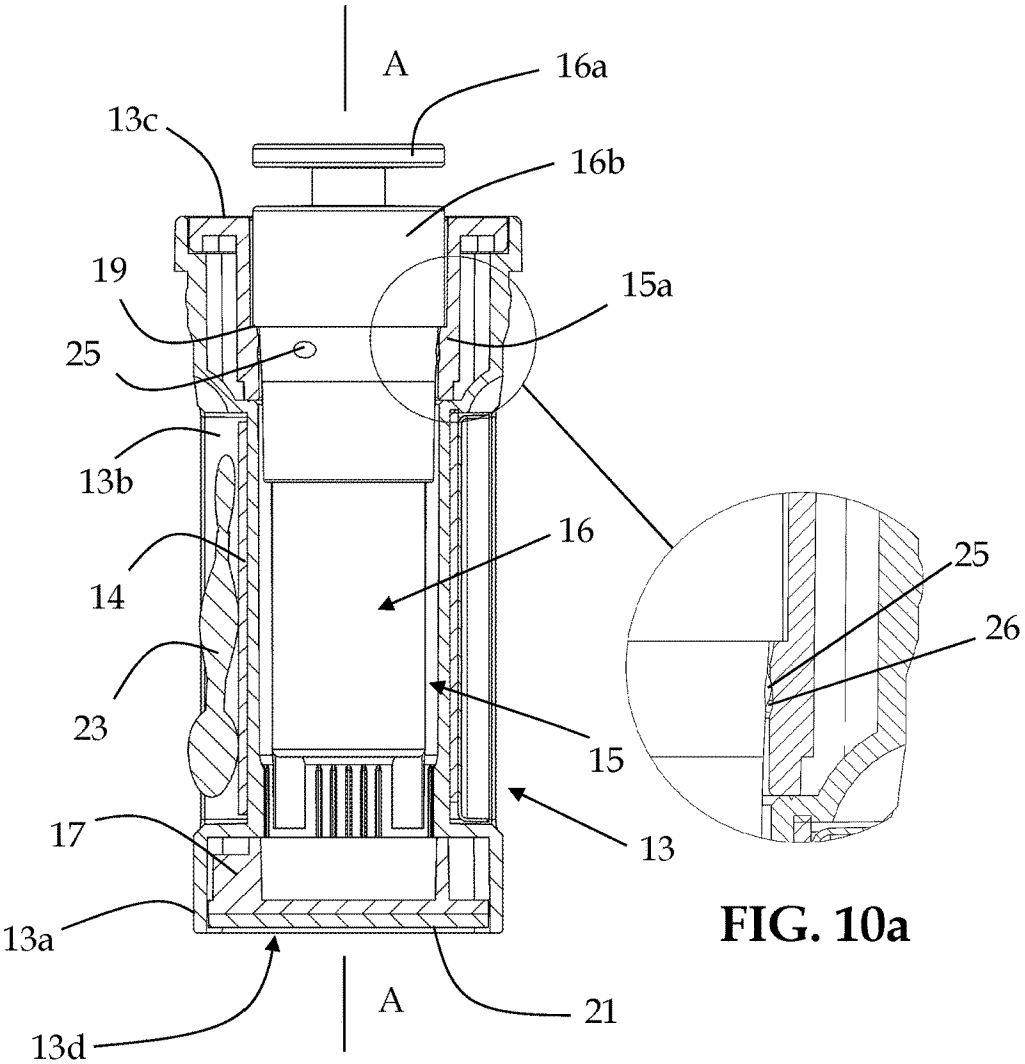
FIG. 10a
FIG. 10
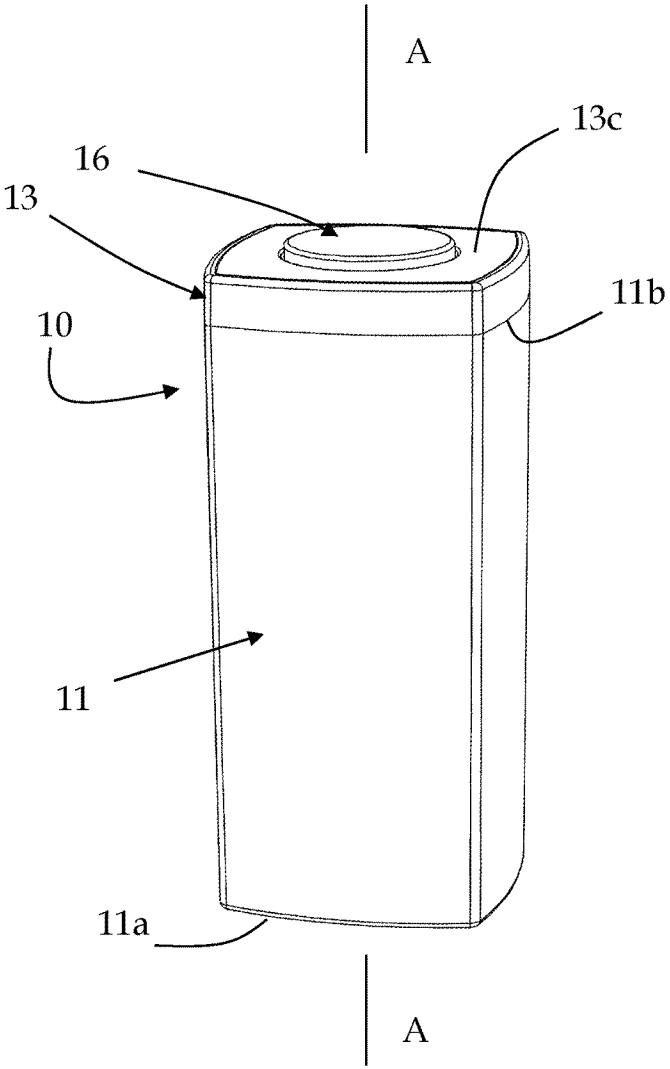
FIG. 11

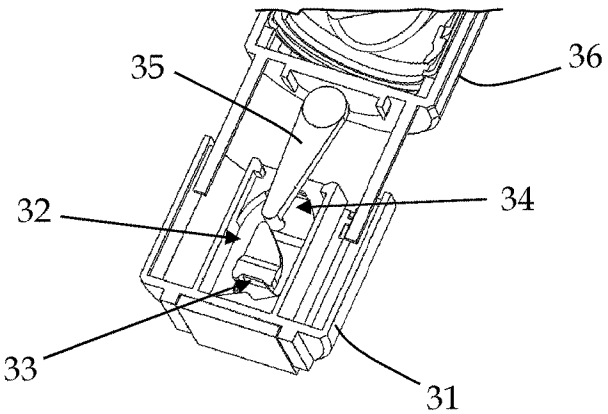
FIG. 13
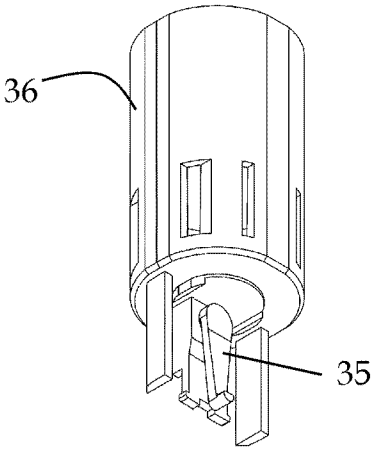
FIG. 14
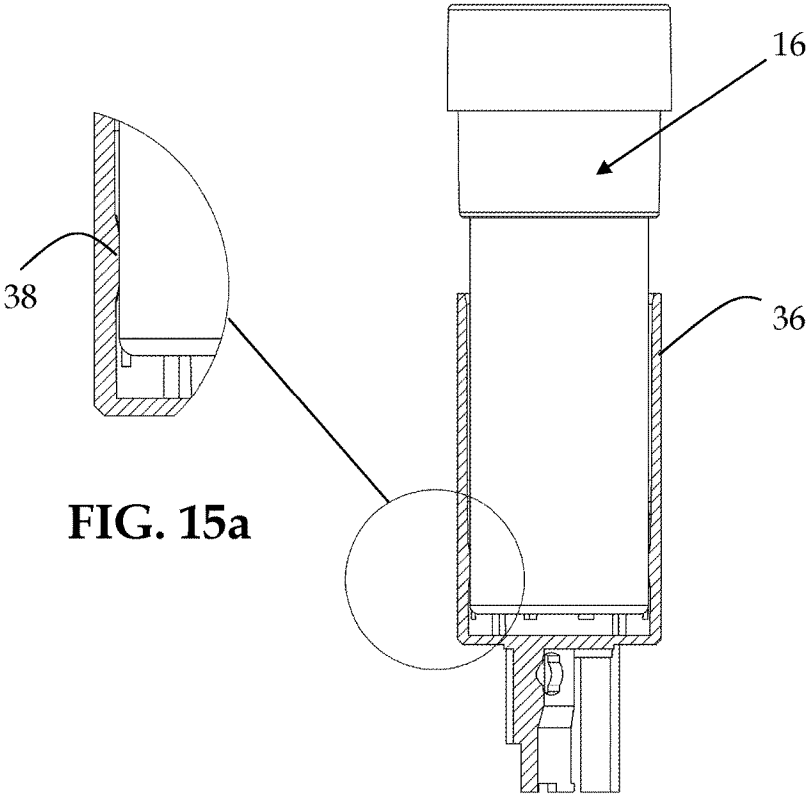
FIG. 15
FIG. 15a

COMPACT COSMETIC CASE

BACKGROUND

The present invention generally relates to an apparatus for containing cosmetic articles and, more particularly, to a cosmetic case for containing a plurality of cosmetic articles in a compact manner, like e.g. cosmetic products and cosmetic accessories. It relates in particular, although not exclusively, to cosmetic cases for containing lipstick, mascara, lip-gloss, foundation, eye shadow or blusher, nail varnish, make-up mirrors and make-up brushes.

Make-up generally requires the use of a plurality of cosmetic products and cosmetic articles comprising, amongst others, foundation and blusher for the face skin, eye shadow and mascara for the eyes, lipstick or lip-gloss for the lips, nail varnish, a make-up mirror and a make-up brush. Moreover, user's usually have the necessity to carry all of the cosmetic products and articles necessary to apply make-up in small handbags.

Accordingly, Applicant identified the need for a cosmetic case suitable for storing a plurality of different cosmetic products and/or articles in order to reduce the number of items to be carried by a user for applying make-up.

The known cosmetic cases for containing a plurality of cosmetic products are usually provided with substantially planar elongated housings made of two half parts hinged to each other along one of the longer sides, like e.g. the case shown in the registered E.U. design n. 003241116-0001.

Such kind of cosmetic cases usually comprise a plurality of basin-like receptacles formed in at least one of the half-parts and filled with a plurality of cosmetic products in powder or paste-like form. Also, a receptacle for a thin make-up brush may be provided. Moreover, the second half-part of the housing usually carries a make-up mirror.

The known cosmetic cases according to the kind described above, although being compact and being suitable for storing a plurality of cosmetic products and articles, are not suitable for containing cosmetic products like lipstick, mascara, lip-gloss, nail varnish which, on the contrary, are usually stored in elongated tubular cases. As a result, these items may be dropped loosely in a handbag or stored in a larger cosmetic bag, making them hard to find or making the overall cosmetic products to occupy too much space to be carried in small handbags.

Moreover, cosmetic cases for storing cosmetic products like lipstick, mascara, lip-gloss, nail varnish etc. as the one described in U.S. patent application Ser. No. 13/226,885 are also known. The cosmetic case of U.S. Ser. No. 13/226,885 is shaped as an extended box into which elongated tubular cases fit best. On the contrary, it is not optimized for the storage of cases having different shapes. Accordingly, cosmetic products in powder or paste-like form need to be carried in a separate case, thereby resulting to be too bulky to be constantly carried in a handbag.

SUMMARY

Accordingly, Applicant contemplated the problem of overcoming the above-mentioned drawbacks, and, in particular, the problem of reducing the overall space occupied by the plurality of cosmetic products and articles necessary to apply make-up.

Within the scope of the above problem, the Applicant considered the objective of realizing a cosmetic case suitable for storing a plurality of cosmetic products and cosmetic articles in a compact manner irrespective of the nature and shape of the cosmetic products and articles.

Accordingly, in a first aspect of the present invention, a cosmetic case comprises an inner body carrying on its outer surface a plurality of basin-shaped receptacles for housing a cosmetic product or a cosmetic article, and a plurality of cosmetic products and/or cosmetic articles each retained within a basin-shaped receptacle of the plurality of basin-shaped receptacles, wherein the inner body has an elongated shape developing along a main axis, the shape of the inner body being provided with a lateral surface developing around the main axis, and a first and a second end surface orthogonal to the main axis; wherein at least one basin-shaped receptacle of the plurality of basin-shaped receptacles is provided at the lateral surface of the inner body; and wherein at least one elongated receptacle is provided inside the inner body, the elongated receptacle extending coaxially to the main axis and being accessible through an aperture obtained on the first and/or second end surface of the inner body.

Applicant realized that the arrangement of basins-shaped receptacles on a surface which develops around the main axis, in addition to an elongated receptacle accessible from an end surface transversal (e.g. orthogonal) to the main axis and developing parallel to the main axis optimizes the space requirement for storing a plurality of different cosmetic products and articles, and also allows the simultaneous storing of products of different shapes, like e.g. cosmetic products traditionally stored in elongated tubular cases (i.e. lipstick, lip-gloss, mascara etc.).

In a second aspect of the present invention a cosmetic case comprises an inner body carrying on its outer surface a plurality of basin-shaped receptacles for housing a cosmetic product or a cosmetic article, and a plurality of cosmetic products and/or cosmetic articles each retained within a basin-shaped receptacle of the plurality of basin-shaped receptacles, wherein the inner body has an elongated shape developing along a main axis, the shape of the inner body being provided with a lateral surface developing around the main axis, and a first and a second end surface transversal to the main axis; wherein at least one basin-shaped receptacle of the plurality of basin-shaped receptacles is provided at the lateral surface of the inner body; and wherein at least one elongated receptacle is provided inside the inner body, the elongated receptacle extending parallel to the main axis and being accessible through an aperture obtained on the first and/or second end surface of the inner body.

The present invention in at least one of the above aspects may have at least one of the following preferred features; the latter may in particular be combined with each other as desired to meet specific implementation purposes.

In a preferred embodiment, an axial applicator is provided, the axial applicator being shaped so as to be at least partially insertable into the elongated receptacle by an axial movement.

In a preferred embodiment, the inner body comprises a mechanism for releasably retaining the axial applicator within the elongated receptacle.

In a preferred embodiment, the mechanism for releasably retaining the axial applicator within the elongated receptacle is a screw connection implemented by a first threaded portion obtained on an outer lateral wall portion of the axial applicator and a second threaded portion obtained on an inner lateral wall portion of the elongated receptacle.

In a more preferred embodiment, the first threaded portion of the outer lateral wall of the applicator is provided directly below a radially enlarged portion of the outer wall so as to implement a stop limit to the screwing travel of the axial applicator into the elongated receptacle.

In a preferred embodiment, the mechanism for releasably retaining the axial applicator within the elongated receptacle is a pair of magnetically interacting elements, a first magnetically interacting element of the pair of magnetically interacting elements being provided inside the applicator and a second magnetically interacting element of the pair of magnetically interacting elements being provided inside the elongated body, in particular in the proximity of the elongated receptacle.

In a more preferred embodiment, the magnetically interacting elements are annular magnetically interacting elements, in particular an annular permanent magnet and an annular ferromagnetic element, and wherein a first annular magnetically interacting element is housed inside the inner body, in particular, directly underneath the end surface carrying the aperture, and a second annular magnetically interacting element is housed inside the applicator, in particular, in a radially enlarged portion of the outer wall of the applicator which substantially rests at the aperture when the applicator is fully inserted in the elongated receptacle so that, in the fully inserted configuration, the first and second magnetically interacting elements are substantially at a same axial position.

In a preferred embodiment, the mechanism for releasably retaining the axial applicator within the elongated receptacle comprises a plurality of radially outwardly projecting elements and at least one recess respectively obtained on the inner lateral wall of the elongated receptacle and on the outer lateral wall of axial applicator, wherein the plurality of radially outwardly projecting elements and the at least one recess elastically couple together so as to realize a releasable snap fit connection.

In a preferred embodiment, the mechanism for releasably retaining the axial applicator within the elongated receptacle comprises a sliding guide fixedly connected to a bottom of the elongated receptacle, wherein the sliding guide defines a guiding travel which develops in a plane parallel to the main axis and which is provided with at least two stable positions, a first stable position being proximal to the bottom of the elongated receptacle and a second stable position being distal from the bottom of the inner body; a retaining container slidably provided inside the elongated receptacle and configured to elastically engage with the lateral wall of the axial applicator for releasably retaining the applicator in an at least partially inserted configuration inside the retaining container; a hook element which slidably engages the sliding guide at a first end of the hook element, and is rigidly connected to the retaining container at a second end; and a spring-loaded element provided between the retaining container and the bottom of the elongated receptacle.

In a more preferred embodiment, the retaining container is provided with a plurality of inwardly radially projecting bumps configured to elastically engage with the lateral wall of the axial applicator.

In a preferred embodiment, the elongated shape of inner body is at least one of a pyramidal or pyramidal frustum shape, a conical or conical frustum shape or a tubular shape with a polygonal or circular or elliptic section.

In a preferred embodiment, the cosmetic case further comprises an outer cover having a substantially hollow elongated shape which develops along the main axis between a first blind end and a second open end, thereby defining an inner elongated housing chamber open at one end, wherein the housing chamber has a shape substantially complementary to the shape of the inner body in order for the inner body to be able to be inserted into the housing chamber through the second open end.

In a preferred embodiment, the inner body has a lateral surface with four planar portions, thereby having a tubular shape with quadrilateral section.

In a preferred embodiment, the basin-shaped receptacles have a substantially planar shape and/or are obtained on a planar portion of the lateral surface of the inner body.

In a preferred embodiment, at least one cosmetic product of the plurality of cosmetic products and/or at least one cosmetic article of the plurality of cosmetic articles is releasably housed within a basin-shaped receptacle of the plurality of the basin-shaped receptacles.

In a preferred embodiment, a magnet is fixedly connected to a bottom of at least one basin-shaped receptacle of the plurality of the basin-shaped receptacles and at least one cosmetic product of the plurality of cosmetic products and/or at least one cosmetic article of the plurality of cosmetic articles is provided with at least one ferromagnetic or magnetic insert or is housed in a magnetic or ferromagnetic container.

In a preferred embodiment, the plurality of cosmetic products comprises at least one between lipstick, mascara, lip-gloss, nail varnish, foundation, eye shadow and blusher, and the plurality of cosmetic articles comprises at least one between make-up mirror and make-up brush.

In a preferred embodiment, the axial applicator internally defines a chamber configured to house a cosmetic product or a cosmetic article, or wherein the axial applicator is a make-up brush applicator for applying a make-up product stored inside the elongated receptacle.

In a preferred embodiment, at least one basin-shaped receptacle of the plurality of basin-shaped receptacles is provided at an end surface of the inner body opposite to the first or second end surface bearing the aperture for accessing the elongated receptacle; or wherein a make-up mirror is glued to an end surface of the inner body opposite to the first or second end surface bearing the aperture for accessing the elongated receptacle.

BRIEF DESCRIPTION OF THE DRAWINGS

With reference to the attached drawings, further features and advantages of the present invention will be shown by means of the following detailed description of some of its preferred embodiments.

According to the above description, the several features of each embodiment can be unrestrictedly and independently combined with each other in order to achieve the advantages specifically deriving from a certain combination of the same.

Figure 1:
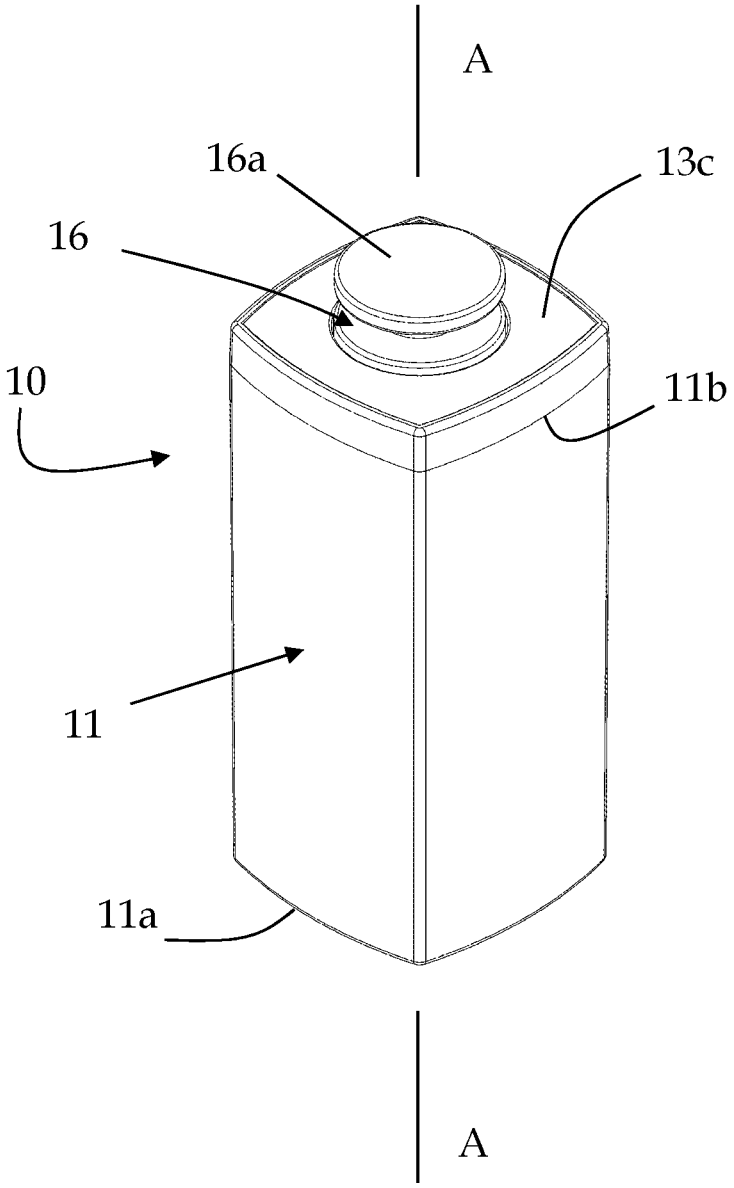
Figure 2:
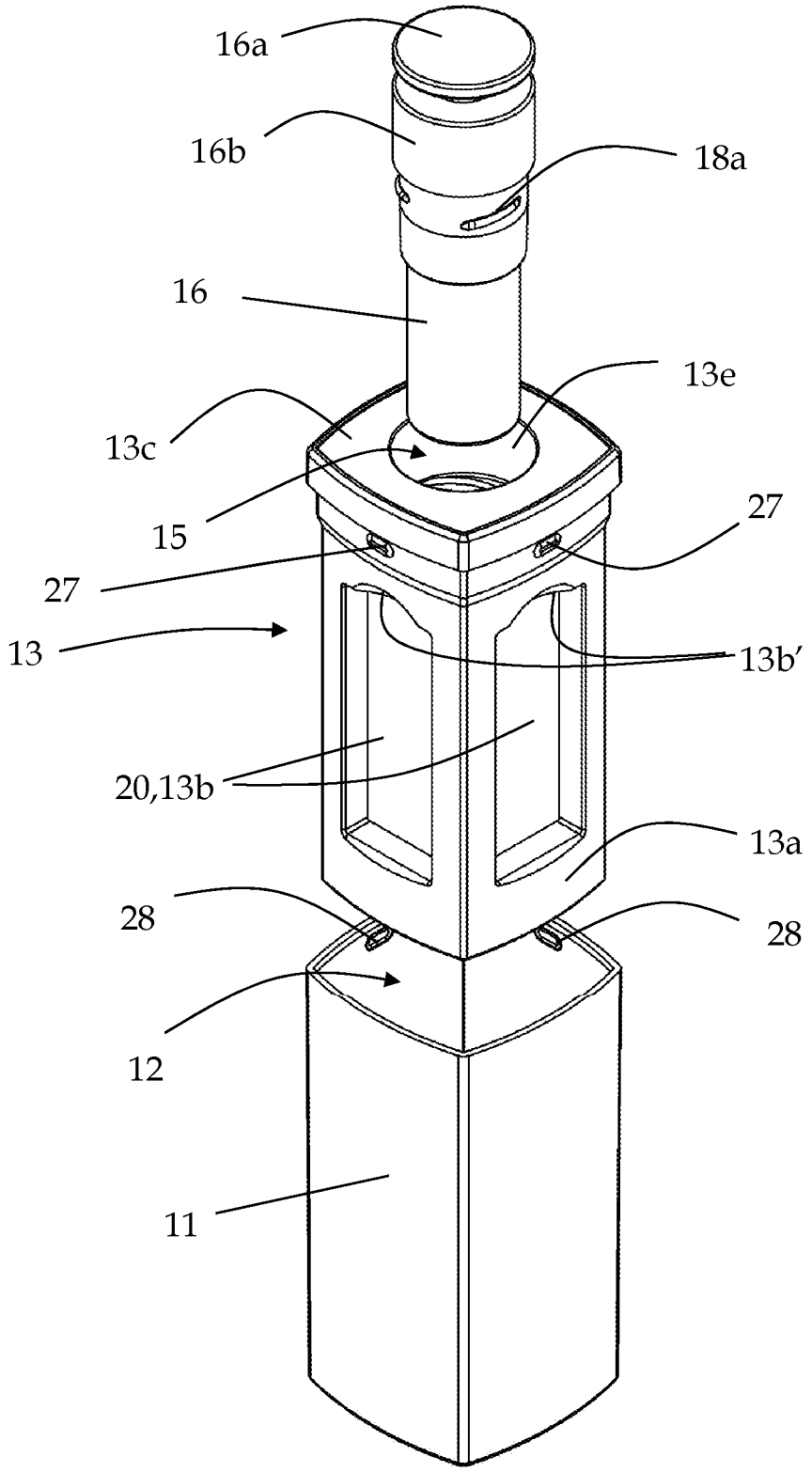
Figure 3:
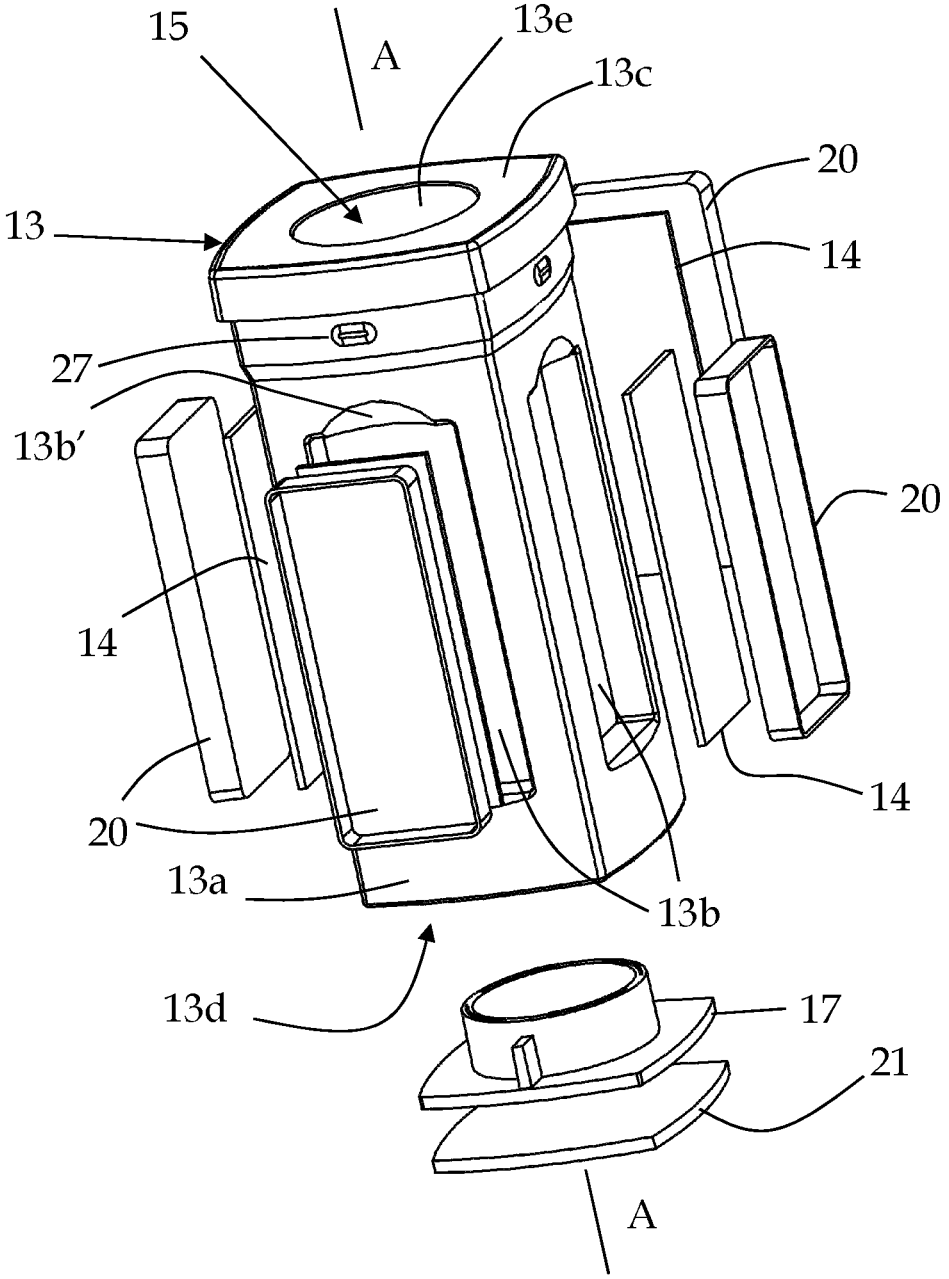
Figure 4:
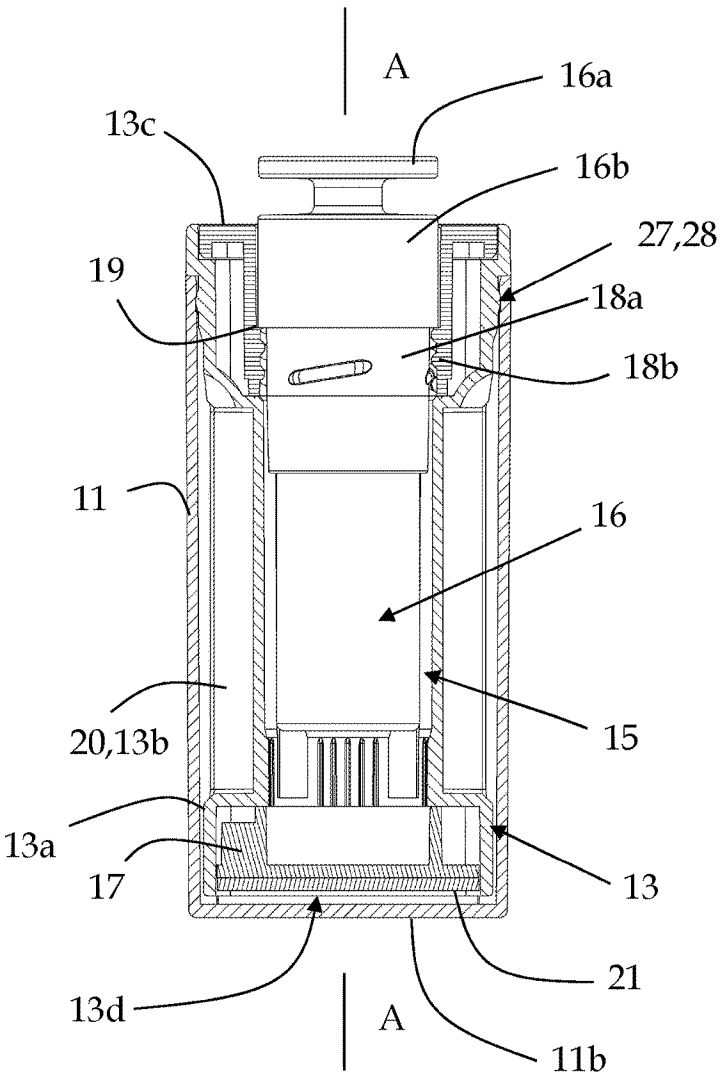
Figure 5:
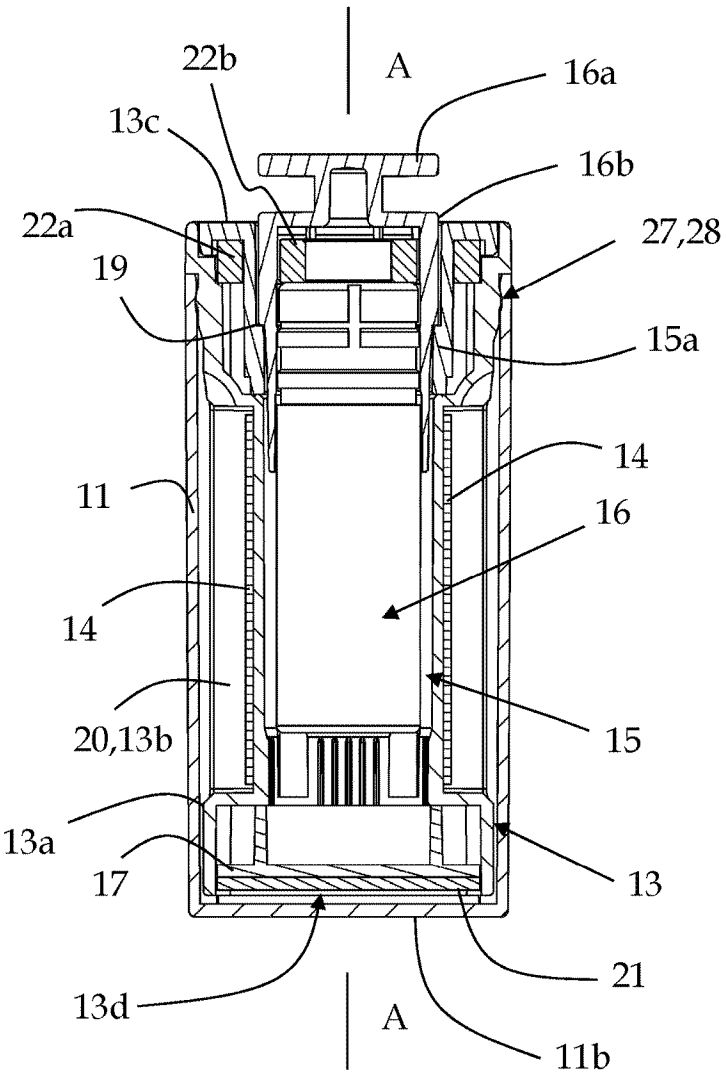
Figure 6:
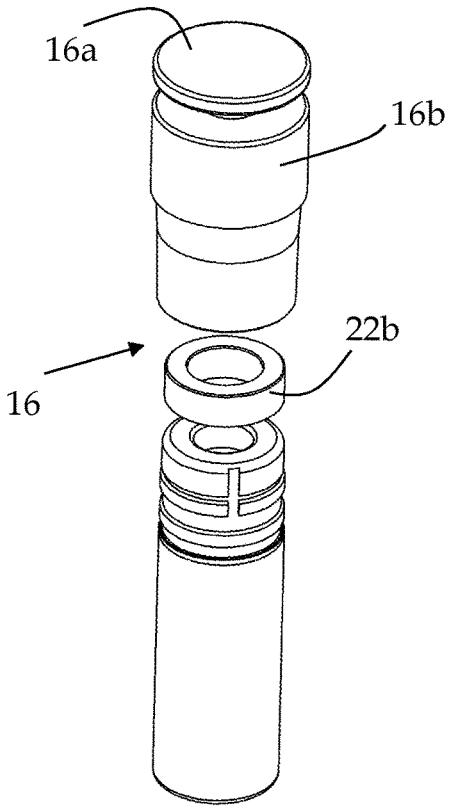
Figure 7:
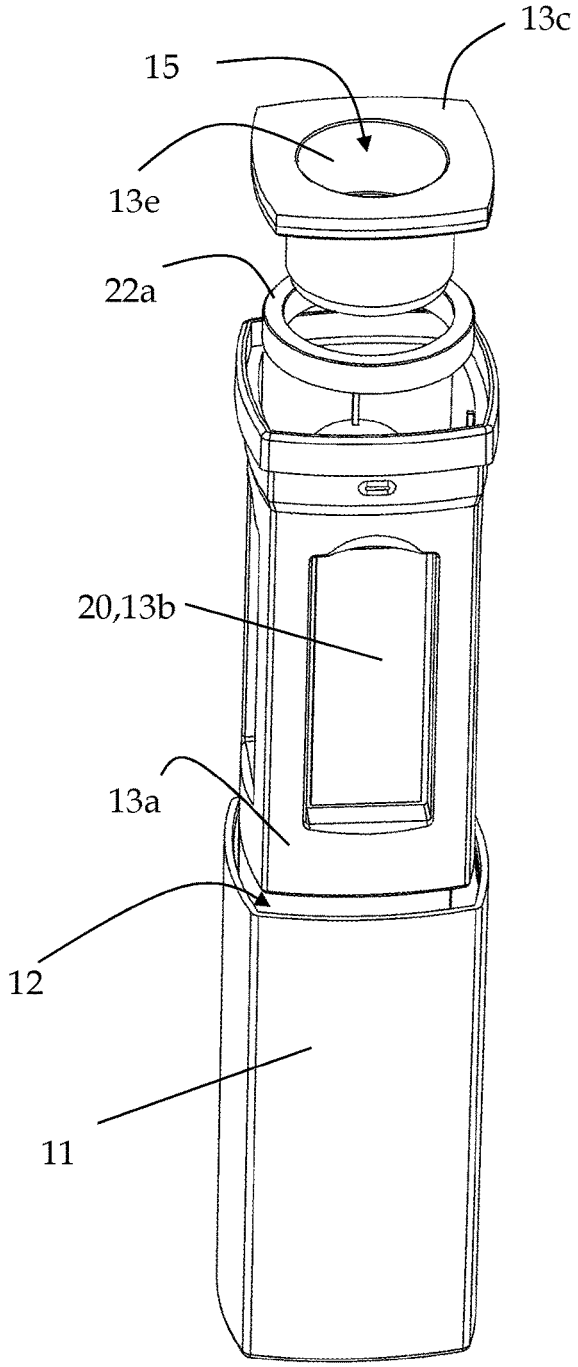
Figure 8:
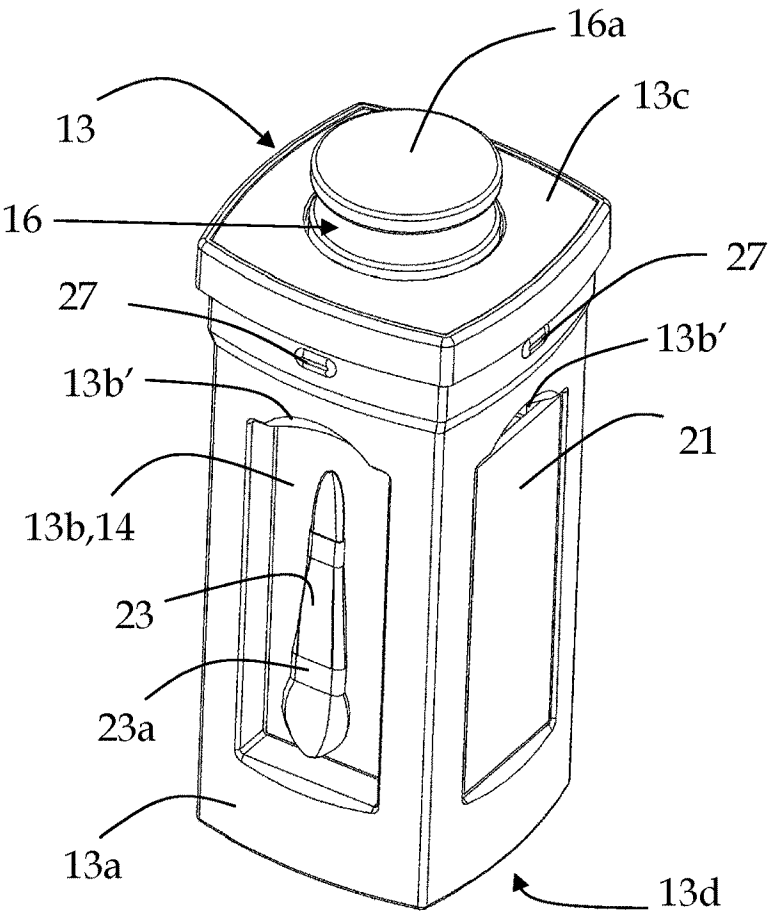
Figure 9:
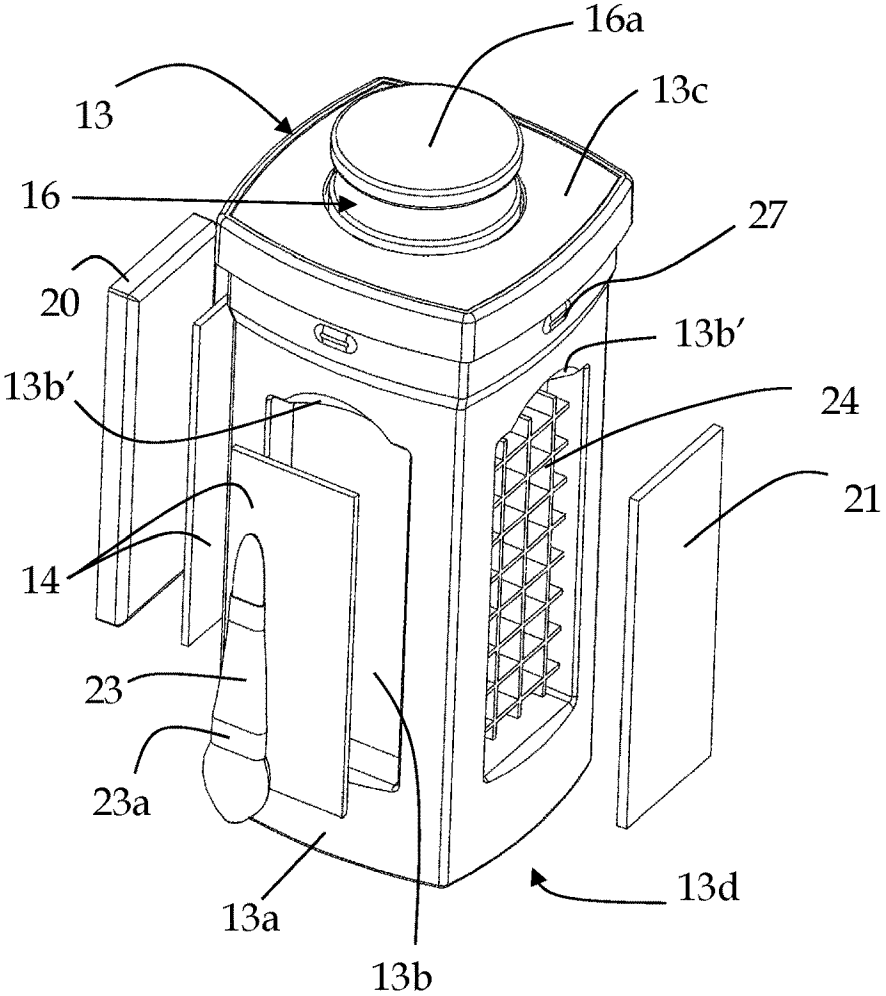
Figure 12:
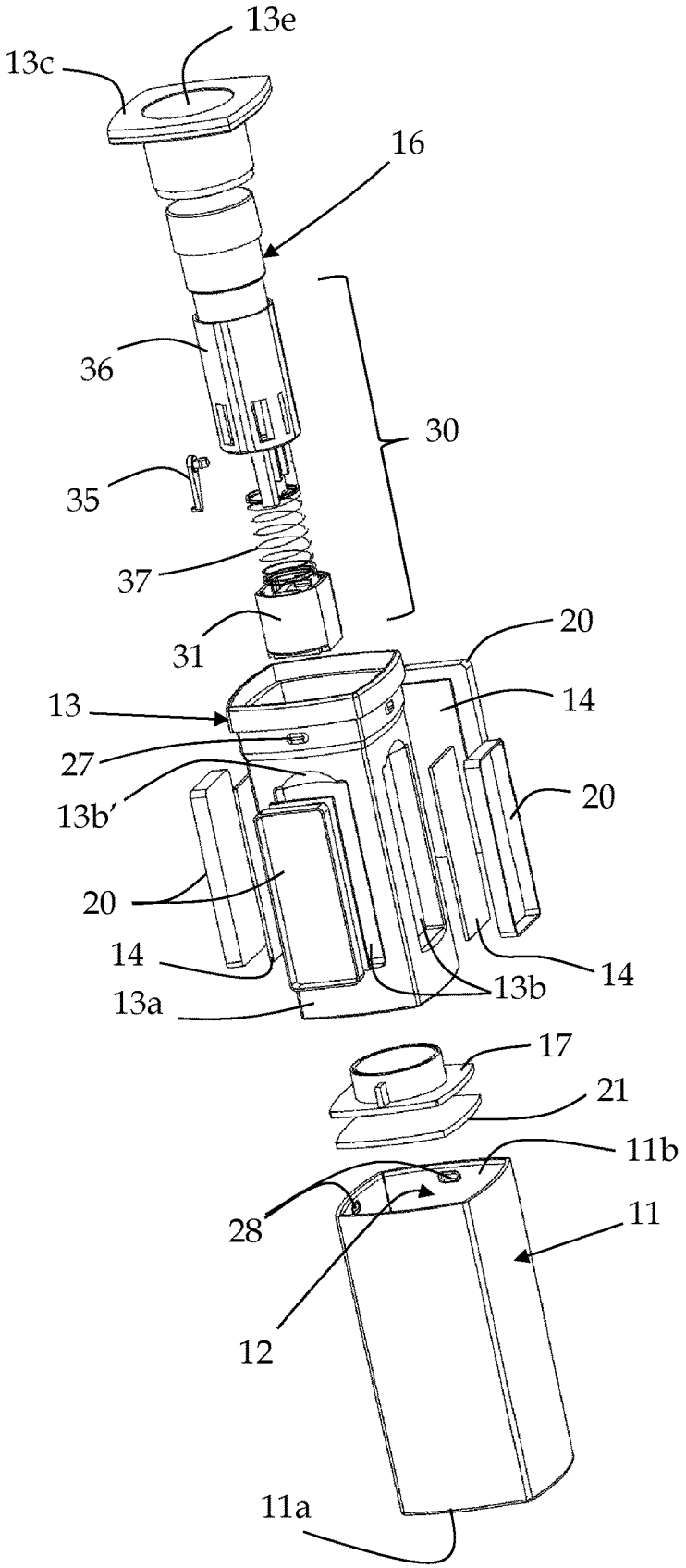

In the said drawings,

FIG. 1 is a perspective view of a cosmetic case according to a first preferred embodiment of the present invention, illustrated in a closed configuration;

FIG. 2 is a perspective view of the cosmetic case as in FIG. 1, illustrated in an open configuration;

FIG. 3 is a partially exploded view of an inner body of the cosmetic case as in FIGS. 1 and 2;

FIG. 4 is a section view of the cosmetic case as in FIG. 1;

FIG. 5 is a section view of a cosmetic case according to a second preferred embodiment of the present invention;

FIG. 6 is an exploded view of a central applicator of the cosmetic case as in FIG. 5;

FIG. 7 is an exploded view of an inner body and a cover of the cosmetic case as in FIG. 5;

FIG. 8 is a perspective view of an inner body of a cosmetic case according to a third preferred embodiment with the axial applicator inserted into the inner body;

FIG. 9 is a partially exploded view of the inner body as in FIG. 8;

FIG. 10 is respectively a section view of the inner body as in FIG. 8;

FIG. 10*a* is an enlarged detail of FIG. 10;

FIG. 11 is a perspective view of a cosmetic case according to a fourth preferred embodiment of the present invention, illustrated in a closed configuration;

FIG. 12 is an exploded view of the cosmetic case as in FIG. 11;

FIG. 13 is a partial cut view of a detail of the closing mechanism of the cosmetic case as in FIG. 11;

FIG. 14 is perspective view of an element of the closing mechanism of the cosmetic case as in FIG. 10;

FIG. 15 is respectively a partial section view of the element as in FIG. 14 with the axial applicator therein retained;

FIG. 15*a* is an enlarged detail of FIG. 15.

DETAILED DESCRIPTION

In the figures and in the following description, identical reference numerals or symbols are used to indicate constructive elements with the same function. Moreover, for the sake of clarity of illustration, it is possible that some references are not repeated in all of the figures.

While the invention can be subject to modifications, or be implemented in alternative ways, in the drawings some preferred embodiments are shown which will be discussed in detail in the following. However, it should be understood that there is no intention to limit the invention to the specific embodiments described, but on the contrary, the invention is meant to cover all the modifications or alternative and equivalent implementations which fall within the scope of protection of the invention as defined in the claims.

Expressions like "example given", "etc.", "or" indicate non-exclusive alternatives without limitation, unless expressly differently indicated. Expressions like "comprising" and "including" have the meaning of "comprising or including, but not limited to" unless expressly differently indicated.

With reference to FIG. 1, a cosmetic case 10 according to a first preferred embodiment of the present invention is provided. The cosmetic case 10 comprises an outer cover 11 having a substantially hollow tubular shape which develops along a main axis A between a first blind end and 11*a* a second open end 11*b* and thereby defines an inner elongated housing chamber 12 open at one end.

As shown in FIG. 2, the cosmetic case 10 also comprises an inner body 13 with a shape which is substantially complementary with respect to the housing chamber 12 defined inside the cover 11 in order for the body 13 to be able to be inserted into the housing chamber 12.

In general, the inner body 13 has an elongated shape which develops along the main axis A, like e.g. a pyramidal or pyramidal frustum shape, a conical or conical frustum shape or a tubular shape with a polygonal or circular section or equivalent sections e.g. an oval section. According to some embodiments, the shape of the inner body 13 can be, in particular, axially symmetric with respect to the main axis A.

On a lateral surface 13*a* of the elongated body 13 at least one basin-shaped 13*b* receptacle is provided. Moreover, on the lateral surface 13*a* of the elongated body 13 at least one retaining projection 27 is provided in order to releasably retain the cover 11 onto the inner body 13. The retaining projections 27 engage into corresponding recessed portions 28 obtained on the inner surface of the inner housing chamber 12 defined by the cover.

In the embodiment of FIG. 2, there are four basin-shaped receptacles 13*b*. Each receptacle 13*b* has a planar shape and is obtained on a planar portion of the lateral surface 13*a* of the elongated body 13. Accordingly, the inner body 13 has a lateral surface 13*a* with four planar portions thereby having a tubular shape with quadrilateral section.

The basin-shaped receptacles 13*b* shown in FIG. 3 are configured to house a cosmetic product or a cosmetic article 21,23, such as a planar make-up brush or a make-up mirror. A magnet 14, in particular a planar magnet, is fixedly connected (e.g. glued) to the bottom of each basin-shaped receptacle 13*b*.

The cosmetic product is carried in a ferromagnetic (e.g. metal) container 20 in order to adhere to the planar magnet 14 by the magnetic force exerted by the same. In particular, the planar magnet 14 exerts a releasable retention on the metal container 20 in order to make it possible to exchange an empty container 20 (e.g. when the cosmetic product is finished) with a new full one 20. For this purpose, the basin-shaped receptacle 13*b* comprises an inclined wall 13*b*' allowing the insertion of a fingernail or of a tool in order to exert a force suitable for detaching the metal container from the magnet 14.

A first end surface 13*c* of the inner body 13 is provided with an aperture 13*e* which allows to access to an elongated receptacle 15 provided inside the inner body 13 and extending along the main axis A. A second end surface 13*d* of the inner body is closed (e.g. by means of cap 17) and a make-up mirror is glued thereon. In the alternative, at the closed second end surface 13*d* an additional basin-shaped receptacle 13*b* may be provided.

FIG. 2 also shows an axial applicator 16 shaped so as to be able to be inserted into the elongated receptacle 15 provided inside the inner body 13.

Inside the axial applicator 16 of FIG. 2 a chamber is defined which is configured to house a cosmetic product (like e.g. lipstick, mascara, lip-gloss, nail varnish) or a cosmetic article (like e.g. a make-up brush). In alternative embodiments, the axial applicator 16 is a make-up brush applicator (e.g. for applying mascara or lip-gloss) for applying a make-up product stored inside the elongated receptacle 15 and the elongated receptacle 15 itself is filled with a cosmetic product, in particular with a liquid or viscous cosmetic product (e.g. mascara or lip-gloss).

The axial applicator of FIG. 2 is provided with an axial grip handle 16*a* which in the closed configuration, projects from the elongated receptacle 15 when the axial applicator 16 is inserted in the receptacle 15. This allows easily extracting the axial applicator 16 from the receptacle 15.

Inside the elongated receptacle 15 of the inner body 13, a mechanism for releasably retaining the axial applicator 16 within the elongated receptacle 15 is provided.

According to the first embodiment, the inner lateral wall of the elongated receptacle 15 and the outer lateral wall of axial applicator 16 comprise each a threaded portion 18*a*, 18*b*. The two threaded portions 18*a*,18*b* implement together a screw connection. The threaded portion 18*a* of the outer lateral wall of the applicator 16 is provided just below a radially enlarged portion 16*b* of the outer wall 16. When the axial applicator 16 is fully inserted in the elongated receptacle 15, the enlarged portion 16*b* of the applicator 16 lateral wall abuts against the inwardly projecting threaded portion

18*b* of the inner lateral wall of the elongated receptacle 15. Accordingly, the enlarged portion 16*b* realizes a stop limit 19 to the screwing travel of the axial applicator 16 into the elongated receptacle 15.

With reference to FIG. 5, a cosmetic case 10 according to a second preferred embodiment of the present invention is provided. The second preferred embodiment differs from the first preferred embodiment mainly in the implementation of the mechanism for releasably retaining the axial applicator 16 within the elongated receptacle 15.

As shown in FIG. 5, two magnetically interacting elements 22*a*,22*b* (e.g. a permanent magnet and an element made of a ferromagnetic material) are respectively provided one inside the applicator 16 and one inside the elongated body 13, in particular in the proximity of the elongated receptacle 15. Accordingly, when the applicator 16 is inserted in the elongated receptacle 15 of the elongated body 13, the two magnetically interacting elements 22*a*,22*b* exert a reciprocal attraction force which releasably maintains the applicator 16 inside the receptacle 15. The applicator 16 can be extracted from the receptacle 15 by axially pulling the applicator 16 and thereby exerting an axial force which exceeds the magnetic attraction force.

In particular, as best shown in FIG. 6 and FIG. 7, the two magnetically interacting elements 22*a*,22*b* are an annular permanent magnet 22*a* housed inside the inner body 13 and an annular ferromagnetic element 22*b* housed in a radially enlarged portion 16*b* of the outer wall 16 of the applicator 16. The annular permanent magnet 22*a* is housed directly underneath the first end surface 13*c* carrying the aperture 13*e*. The radially enlarged portion 16*b* is obtained just below the grip handle 16*a* of the applicator 16. Also, an opposite configuration is possible in which the permanent magnet 22*a* is hosed inside the axial applicator 16 and the ferromagnetic element 22*b* is housed inside the inner body 13.

The inner lateral wall of the elongated receptacle 15 comprises an inwardly radially projecting portion 15*a* which realizes a stop limit 19 to the insertion travel of the axial applicator 16 into the elongated receptacle 15. In fact, when the axial container is fully inserted in the elongated receptacle, the radially enlarged portion 16*b* of the outer wall 16 of the applicator 16 abuts against the inwardly radially projecting portion 15*a* of the elongated receptacle 15. In this fully inserted position (shown in FIG. 5), the first and second magnetically interacting elements 22*a*,22*b* are substantially at a same axial position in order to exert the maximum magnetic attraction force.

With reference to FIG. 8, the inner body 13 of a cosmetic case 10 according to a third preferred embodiment of the present invention is provided. The inner body 13 of FIG. 8 differs from the ones of the previous embodiments for the fact that two cosmetic articles 21,23 are housed inside the basin-shaped receptacles 13*b* obtained in the lateral surface 13*a* of the inner body 13.

In a first lateral basin-shaped receptacle 13*b* a make-up brush 23 is housed. The make-up brush 23 is provided with at least one ferromagnetic (e.g. metal) or magnetic insert 23*a* (e.g. two metal ties 23*a*) in order to realize a releasable connection to the magnet 14 glued to the bottom of the basin-shaped receptacle 13*b*.

As shown in FIG. 8, a make-up mirror 21 is fixed (e.g. glued) inside a second lateral basin-shaped receptacle 13*b*. As depicted in FIG. 9, the depth of the second lateral basin-shaped receptacle 13*b* is filled with a supporting structure 24 which makes the mirror 21 to be substantially aligned with the lateral surface 13*a* of the inner body 13.

Moreover, the inner body 13 of FIG. 8 differs from the ones of the previous embodiments for the implementation of the mechanism for releasably retaining the axial applicator 16 within the elongated receptacle 15.

As shown in FIG. 10, the outer lateral wall of axial applicator 16 and the inner lateral wall of the elongated receptacle 15 respectively comprise a plurality of radially outwardly projecting elements 25 and an annular recess 26 which couples with the projecting elements 25 in order to realize a releasable snap fit connection.

In the depicted embodiment, the annular recess 26 is obtained on the inner lateral wall of the elongated receptacle 15, in particular on an inwardly radially projecting portion 15*a* thereof. The radially outwardly projecting elements 25 are obtained directly below a radially enlarged portion 16*b* of the outer wall of the axial applicator 16. However, also an opposite configuration is possible in which the annular recess 26 is obtained on the outer wall of the axial applicator 16 and the radially outwardly projecting elements 25 are obtained on the inner lateral wall of the elongated receptacle 15.

When the axial applicator 16 is inserted into the elongated receptacle 15, the projecting elements 25 are slightly radially pressed by the action exerted by the inner wall of the elongated receptacle 15 and are subject to a slight elastic deformation. Accordingly, when the projecting elements 25 reach the annular recess 26 they elastically return to their original radial position and snap into the recess 26 thereby realizing a releasable snap fit connection. In this position, the inwardly radially projecting portion 15*a* of the receptacle wall and the radially enlarged portion 16*b* of the applicator lateral wall abut against each other, thereby realizing a stop limit 19 to the insertion travel of the axial applicator 16 into the elongated receptacle 15.

The applicator 16 can be extracted from the receptacle 15 by axially pulling the applicator 16. Accordingly, the projecting elements 25 experience again a slight elastic deformation which allows the disengagement from the annular recess 26.

With reference to FIG. 11, a cosmetic case 10 according to a fourth preferred embodiment of the present invention is provided. The fourth preferred embodiment differs from the previous preferred embodiments mainly in the fact that the axial applicator 16 is not provided with a handle grip 16*a* which projects from the elongated receptacle 15 in the closed configuration according to which the axial applicator 16 is inserted in the receptacle 15 and in the implementation of the mechanism for releasably retaining the axial applicator 16 within the elongated receptacle 15.

According to the fourth embodiment, the axial applicator 16 is configured so as to be flush with the first end surface 13*c* of the inner body 13 of the case 10 when it is inserted in the receptacle 15, as shown in FIG. 11.

To extract the axial applicator 16 from the receptacle 15, a so-called push-pull connection mechanism 30 is provided inside the inner body 13.

The connection mechanism 30 of the fourth embodiment comprises a cup-shaped element 31 which is fixedly connected inside the inner body 13 and to the bottom of the same (e.g. to cap 17). The cup element 31 carries a sliding guide 32 defining a guiding travel which develops in a plane parallel to the main axis A and which is provided with at least two stable positions 33,34. A first stable position 33 is proximal to the bottom of the inner body 13 and a second stable position 34 is distal from the bottom of the inner body 13.

The connection mechanism 30 further comprises a hook element 35 which slidably engages the sliding guide 32 at one end of the hook element 35, and is rigidly connected to a retaining container 36, at the other end. Moreover, a spring-loaded element 37 is provided between the retaining container 36 and the bottom of the inner body 13.

The retaining container 36 is provided with a plurality of inwardly radially projecting bumps 38 configured to elastically engage with the lateral wall of the axial applicator 16, thereby realizing a releasable retention of the axial applicator within the retaining container 36 by force coupling.

Accordingly, when the hook element 35 is engaged in the proximal stable position 33, the retaining container 36 is in a position of maximum insertion within the elongated receptacle 15. In this configuration, the axial applicator 16 carried by the retaining container 36 is flush with the first end surface 13*c* of the inner body 13 (as shown in FIG. 11).

When an axial pressure is exerted on the axial applicator towards the inside of the elongated receptacle 15, the hook element 35 disengages from the proximal stable position 33. In this free arrangement, the spring-loaded element 37 pushes the retaining container 36 towards the exit of the elongated receptacle 15 in a position of maximum extraction which coincides with the position in which the hook element 35 reaches the distal stable position 34 of the sliding guide 32.

In this extracted configuration, the axial applicator 16 carried by the retaining container 36 projects from the first end surface 13*c* of the inner body 13 and can be removed from the retaining container 36 by axially pulling the applicator 16, namely by exerting an axial force which exceeds the retaining force generated by the elastic engagement of the projecting bumps 38 which act against the lateral wall of the applicator 16.

The invention claimed is:

1. A cosmetic case comprising:

an inner body carrying on an outer surface a plurality of basin-shaped receptacles for housing a cosmetic product or a cosmetic article, and a plurality of cosmetic products and/or cosmetic articles each retained within a basin-shaped receptacle of the plurality of basin-shaped receptacles;

an outer cover having a substantially hollow elongated shape which develops along the main axis between a first permanent blind end and a second permanent open end, thereby defining an inner elongated housing chamber open at one end;

wherein the housing chamber has a shape substantially complementary to the shape of the inner body in order for the inner body to be able to be fully removably insertable into the housing chamber through the second permanently open end and a first retaining mechanism for releasably and detachably retaining the inner body in the housing chamber is provided on the inner surface of the housing chamber, in order for the first retaining mechanism to engage with a lateral surface of the inner body;

wherein the inner body has an elongated shape developing along a main axis, the shape of the inner body being provided with a lateral surface developing around the main axis, and a first and a second end surface orthogonal to the main axis;

wherein at least one basin-shaped receptacle of the plurality of basin-shaped receptacles is provided at the lateral surface of the inner body;

wherein at least one elongated receptacle is provided inside the inner body, the elongated receptacle extending coaxially to the main axis and being accessible through an aperture obtained on the first and/or second end surface of the inner body;

wherein an axial applicator is partially inserted inside the elongated receptacle in a releasable manner and a second retaining mechanism for releasably retaining the axial applicator within the elongated receptacle is provided inside the elongated receptacle of the inner body;

wherein the axial applicator is disposed at the permanent open end of the outer cover and is withdrawable through the permanent open end; and wherein a chamber housing a cosmetic product is defined inside of the axial applicator.

2. The cosmetic case of claim 1, wherein the second mechanism for releasably retaining the axial applicator within the elongated receptacle is a screw connection implemented by a first threaded portion obtained on an outer lateral wall portion of the axial applicator and a second threaded portion obtained on an inner lateral wall portion of the elongated receptacle.

3. The cosmetic case of claim 2, wherein the first threaded portion of the outer lateral wall of the applicator is provided directly below a radially enlarged portion of the outer wall so as to implement a stop limit to the screwing travel of the axial applicator into the elongated receptacle.

4. The cosmetic case of claim 1, wherein the second mechanism for releasably retaining the axial applicator within the elongated receptacle is a pair of magnetically interacting elements, a first magnetically interacting element of the pair of magnetically interacting elements being provided inside the applicator and a second magnetically interacting element of the pair of magnetically interacting elements being provided inside the elongated body.

5. The cosmetic case of claim 4, wherein the magnetically interacting elements are annular magnetically interacting elements, and wherein a first annular magnetically interacting element is housed inside the inner body directly underneath the end surface carrying the aperture, and a second annular magnetically interacting element is housed inside the applicator, in a radially enlarged portion of the outer wall of the applicator which substantially rests at the aperture when the applicator is fully inserted in the elongated receptacle so that, in the fully inserted configuration, the first and second magnetically interacting elements are substantially at a same axial position.

6. The cosmetic case of claim 1, wherein the second mechanism for releasably retaining the axial applicator within the elongated receptacle comprises a plurality of radially outwardly projecting elements and at least one recess respectively obtained on the inner lateral wall of the elongated receptacle and on the outer lateral wall of axial applicator, wherein the plurality of radially outwardly projecting elements and the at least one recess elastically couple together so as to realize a releasable snap fit connection.

7. The cosmetic case of claim 3, wherein the second mechanism for releasably retaining the axial applicator within the elongated receptacle comprises a sliding guide fixedly connected to a bottom of the elongated receptacle, wherein the sliding guide defines a guiding travel which develops in a plane parallel to the main axis and which is provided with at least two stable positions, a first stable position being proximal to the bottom of the elongated receptacle and a second stable position being distal from the bottom of the inner body;

a retaining container slidably provided inside the elongated receptacle and configured to elastically engage with the lateral wall of the axial applicator for releasably retaining the applicator in an at least partially inserted configuration inside the retaining container;

a hook element which slidably engages the sliding guide at a first end of the hook element, and is rigidly connected to the retaining container at a second end; and a spring-loaded element provided between the retaining container and the bottom of the elongated receptacle.

8. The cosmetic case of claim 7, wherein the retaining container is provided with a plurality of inwardly radially projecting bumps configured to elastically engage with the lateral wall of the axial applicator.

9. The cosmetic case of claim 1, wherein the elongated shape of the inner body is at least one of a pyramidal or pyramidal frustum shape, a conical or conical frustum shape or a tubular shape with a polygonal or circular or elliptic section.

10. The cosmetic case of claim 1, wherein the inner body has a lateral surface with four planar portions, thereby having a tubular shape with quadrilateral section.

11. The cosmetic case of claim 1, wherein the basin-shaped receptacles have a substantially planar shape and/or are obtained on a planar portion of the lateral surface of the inner body.

12. The cosmetic case of claim 1, wherein at least one cosmetic product of the plurality of cosmetic products and/or at least one cosmetic article of the plurality of cosmetic articles is releasably housed within a basin-shaped receptacle of the plurality of the basin-shaped receptacles.

13. The cosmetic case of claim 1, wherein a magnet is fixedly connected to a bottom of at least one basin-shaped receptacle of the plurality of the basin-shaped receptacles and at least one cosmetic product of the plurality of cosmetic products and/or at least one cosmetic article of the plurality of cosmetic articles is provided with at least one ferromagnetic or magnetic insert or is housed in a magnetic or ferromagnetic container.

14. The cosmetic case of claim 1, wherein the plurality of cosmetic products comprises at least one of lipstick, mascara, lip-gloss, nail varnish, foundation, eye shadow and blusher, and the plurality of cosmetic articles comprises at least one of make-up mirror and make-up brush.

15. The cosmetic case of claim 1, wherein at least one basin-shaped receptacle of the plurality of basin-shaped receptacles is provided at an end surface of the inner body opposite to the first or second end surface bearing the aperture for accessing the elongated receptacle; or wherein a make-up mirror is glued to an end surface of the inner body opposite to the first or second end surface bearing the aperture for accessing the elongated receptacle.

16. The cosmetic case of claim 1, wherein the cosmetic product housed in the chamber defined inside the axial applicator is a solid cosmetic product.

17. A cosmetic case comprising:

an inner body carrying on an outer surface a plurality of basin-shaped receptacles for housing a cosmetic product or a cosmetic article, and a plurality of cosmetic products and/or cosmetic articles each retained within a basin-shaped receptacle of the plurality of basin-shaped receptacles;

an outer cover having a substantially hollow elongated shape which develops along the main axis between a first permanent blind end and a second permanent open end, thereby defining an inner elongated housing chamber open at one end;

wherein the housing chamber has a shape substantially complementary to the shape of the inner body in order for the inner body to be able to be fully removably insertable into the housing chamber through the second permanently open end and a first retaining mechanism for releasably and detachably retaining the inner body in the housing chamber is provided on the inner surface of the housing chamber, in order for the first retaining mechanism to engage with a lateral surface of the inner body;

wherein the inner body has an elongated shape developing along a main axis, the shape of the inner body being provided with a lateral surface developing around the main axis, and a first and a second end surface transversal to the main axis;

wherein at least one basin-shaped receptacle of the plurality of basin-shaped receptacles is provided at the lateral surface of the inner body;

wherein at least one elongated receptacle is provided inside the inner body, the elongated receptacle extending parallel to the main axis and being accessible through an aperture obtained on the first and/or second end surface of the inner body;

wherein an axial applicator is partially inserted inside the elongated receptacle in a releasable manner and a second retaining mechanism for releasably retaining the axial applicator within the elongated receptacle is provided inside the elongated receptacle of the inner body;

wherein the axial applicator is disposed at the permanent open end of the outer cover and is withdrawable through the permanent open end; and wherein a chamber housing a cosmetic product is defined inside of the axial applicator.

18. A cosmetic case, comprising:

an inner body carrying on its outer surface a plurality of basin-shaped receptacles for housing a cosmetic product or a cosmetic article, and a plurality of cosmetic products and/or cosmetic articles each retained within a basin-shaped receptacle of the plurality of basin-shaped receptacles, wherein the inner body has an elongated shape developing along a main axis, the shape of the inner body being provided with a lateral surface developing around the main axis, and a first and a second end surface transversal to the main axis;

wherein at least one basin-shaped receptacle of the plurality of basin-shaped receptacles is provided at the lateral surface of the inner body;

wherein at least one elongated receptacle is circumferentially enclosed by the inner body, the elongated receptacle extending parallel to the main axis and being accessible through an aperture obtained on the first and/or second end surface of the inner body; and wherein the inner body is detachably disposed within an outer cover having a permanent blind end and a mirror or cosmetic article is located on the end of the inner body that faces the blind end when the inner body is within the outer cover.

19. The cosmetic case of claim 18, wherein an axial applicator is partially inserted inside the elongated receptacle in a releasable manner, the axial applicator internally defining a chamber configured to house a cosmetic product or a cosmetic article, or wherein the axial applicator is a make-up brush applicator for applying a make-up product stored inside the elongated receptacle.

* * * * *